US005829064A

United States Patent [19]

Huang

[11] Patent Number: 5,829,064

[45] Date of Patent: Nov. 3, 1998

[54] WATER-PROOF GOGGLES

[76] Inventor: Ann Huang, No. 398, Chian Ping 8th St., An Ping District, Tainan, Taiwan

[21] Appl. No.: 879,282

[22] Filed: Jun. 19, 1997

[51] Int. Cl.[6] ..... A61F 9/02

[52] U.S. Cl. ..... 2/428; 2/452

[58] Field of Search ..... 2/452, 428, 430, 2/442, 440, 68

[56] References Cited

U.S. PATENT DOCUMENTS

| | | | |
|---|---|---|---|
| 4,279,039 | 7/1981 | Drew | 2/68 X |
| 5,581,822 | 12/1996 | Tagyo | 2/428 |
| 5,603,125 | 2/1997 | Chou | 2/428 |

*Primary Examiner*—Peter Nerbun
*Attorney, Agent, or Firm*—Rosenberg, Klein & Bilker

[57] ABSTRACT

A pair of goggles includes a pair of ring frames made of plastic material, a pair of lenses of rigid material respectively secured in the ring frames, a bridge mounted between the ring frames, and a strap. Each ring frame includes an annular protective wall formed on an inner side thereof for close contact with an eye socket. Each ring frame further includes an extension strip integrally formed from a lateral side thereof. Each extension strip is made of plastic material and deformable in response to a contour of the user's head, thereby providing a close contact with the sides of the user's head. A buckle is mounted to a distal end of each extension strip for engagement with the strap.

1 Claim, 7 Drawing Sheets

WATER-PROOF GOGGLES

BACKGROUND OF THE INVENTION

1. Field of the Invention

The present invention relates to a pair of goggles with improved water-proof effect for swimming and diving.

2. Description of the Related Art

FIG. 5 of the drawings illustrates a pair of typical goggles for swimming and diving. Such a pair of goggles includes two lenses 30, a pad means 31 mounted around each lens 30, and an elastic strap 33. Each pad means 31 includes an inner peripheral groove 311 for receiving the associated lens 30 and a protective wall 312 on an inner side thereof for close contact with an eye socket. The strap 33 includes a buckle 34 provided to each of two ends thereof for allowing adjustment of a length thereof. In addition, each lens 30 includes a first engaging piece 303 formed on a first side thereof which is distal to the other lens 30, in which the first engaging piece 303 includes a first opening 304 through which an associated end of the strap 33 extends. Each lens 30 further includes a second engaging piece 302 formed on a second side thereof which is adjacent to the other lens 30, in which the second engaging piece 302 includes a second opening 306 defined therein, and a bridge 32 is provided between the two second engaging pieces 302.

The bridge 32 is substantially U-shaped and has a thickness slightly smaller than a width of the second opening. A distance between two ends of the bridge 32 is slightly greater than a distance between the two eye sockets of the user. The bridge 32 includes an inner side having a number of spaced ridges 321 formed thereon for releasably engaging with the second pieces 302. The bridge 32 further includes a smooth outer side to prevent from scraping the user's face.

Nevertheless, the lenses 30, the pad means 31, the bridge 32, the straps 3, and the buckles 34 tend to disengage from each other since they are separate elements and thus adversely affect the water-proof function. In addition, the buckles 34 are adjacent to the pad means 31 such that the buckles 34 might bear against the sides of the user's head. As a result, the ends of the strap 33 cannot have a close contact with the user's head which increases the possibility of leakage in the contact area between the protective walls 312 and the eye sockets. Furthermore, the buckles 34 are apt to be disengaged from the lenses 30 which will cause disengagement of the strap 33.

FIGS. 6 and 7 illustrate an improved goggle structure in which the lenses 40, the pads 41, and the bridge 42 are integrally formed by molding injection, and each pad 41 which forms the frame of the goggles includes a pair of inner peripheral flanges 411 for embracing the lens 40. Each pad 41 further includes a protective wall 412 on an inner side thereof for close contact with the eye socket. An engaging section 413 with an engaging opening 414 is formed on a lateral side of the frame 312 for engaging with an end of the strap 43.

The goggle structure in FIGS. 6 and 7 may solve some of the above-mentioned problems. However, as shown in FIG. 7, the buckles 44 are still proximate to the pad means 44 such that the ends of the strap 43 still cannot have a close contact with the user's head (see the gap "a" in FIG. 7). The buckles 44 are also apt to be disengaged from the pad means 41 which will cause disengagement of the strap 43.

The present invention is intended to provide an improved goggle structure which mitigates and/or obviates the above problems.

SUMMARY OF THE INVENTION

A pair of goggles in accordance with the present invention includes a pair of ring frames made of plastic material, a pair of lenses of rigid material respectively secured in the ring frames, a bridge mounted between the ring frames, and a strap. Each ring frame includes an annular protective wall formed on an inner side thereof for close contact with an eye socket. Each ring frame further includes an extension strip integrally formed from a lateral side thereof. Each extension strip is made of plastic material and deformable in response to a contour of the user's head, thereby providing a close contact with the sides of the user's head. A buckle is mounted to a distal end of each extension strip for engagement with the strap.

Each extension strip may include an indented section formed on a side thereof, in which the indented section has a thickness smaller than that of the extension strip.

In an embodiment of the invention, the buckle has an end integrally formed on the distal end of the associated extension strip. Each extension strip includes a recess defined in the distal end thereof, and the buckle includes a plurality of holes defined in a first end thereof, in which the holes in the first end of the buckle is filled with the plastic material which forms the extension strip by means of molding injection, thereby being securely retained in the groove of the extension strip.

Other objects, advantages, and novel features of the invention will become more apparent from the following detailed description when taken in conjunction with the accompanying drawings.

DESCRIPTION OF THE PREFERRED EMBODIMENTS

Figure 1:
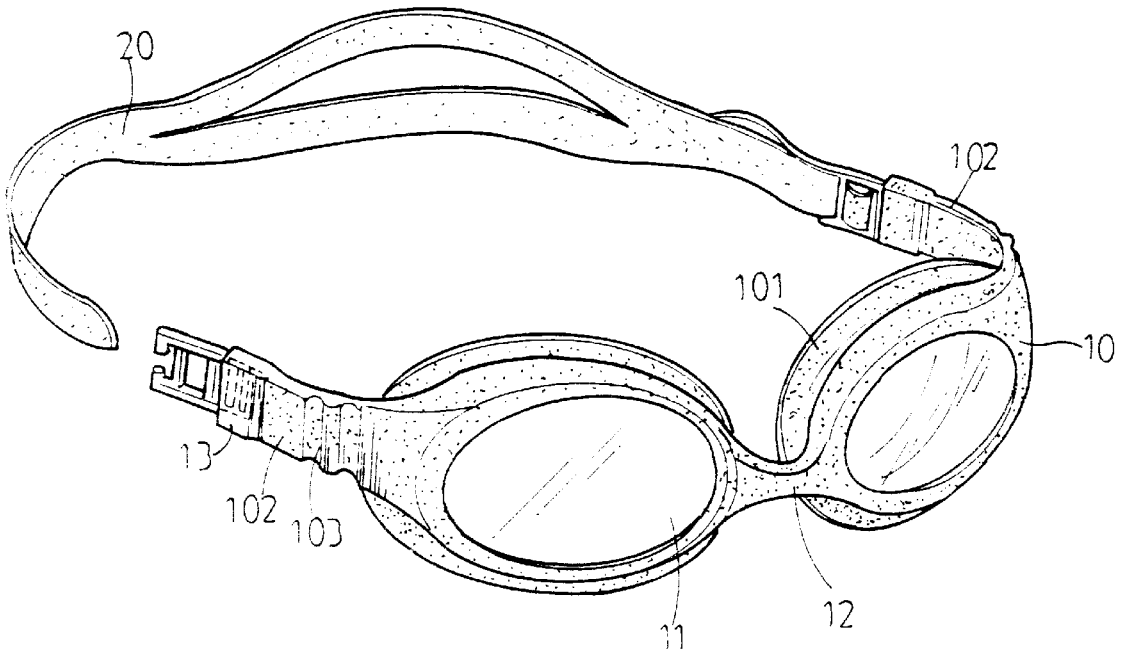
FIG. 1 is a perspective view of a pair of goggles in accordance with the present invention.
Figure 2:
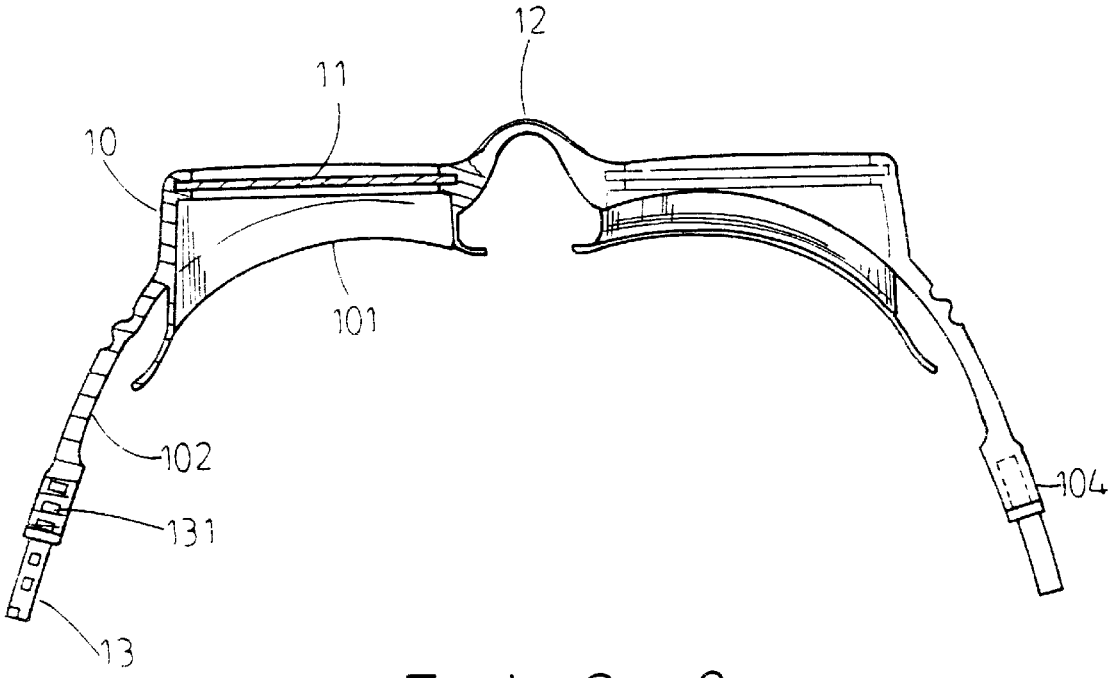
FIG. 2 is a top view, partly sectioned, of a portion of the goggles in accordance with the present invention.
Figure 3:
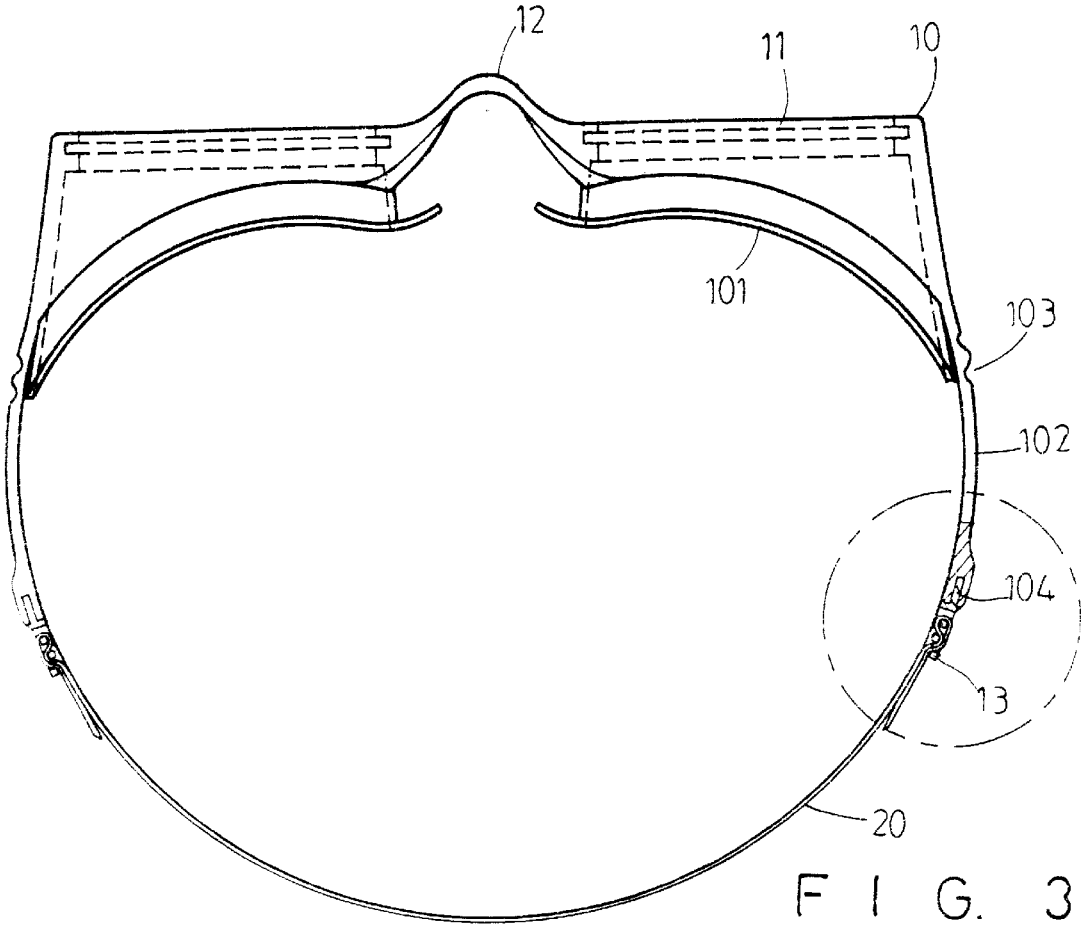
FIG. 3 is a top view, partly sectioned, of the goggles in accordance with the present invention.

Referring to FIGS. 1 to 3, a pair of goggles in accordance with the present invention generally comprises a pair of ring frames 10 made of plastic material, a pair of lenses 11 respectively secured in the ring frames 10, a bridge 12 mounted between the ring frames 10, and a strap 20. Each ring frame 10 includes an annular protective wall 101 formed on an interior side thereof for close contact with an eye socket.

Each ring frame 10 further includes an extension strip 102 integrally formed from a lateral side thereof. The extension strip 102 is made of a deformable material and includes an indented section 103 having a thickness smaller than that of the extension strip 102 so as to deform in response to a contour of the user's head, thereby providing a close contact with the sides of the user's head. Each extension strip 102 has a buckle 13 integrally formed at a distal end thereof for engagement with the strap 20, thereby allowing adjustment of the length of the strap 20.

Figure 3A:
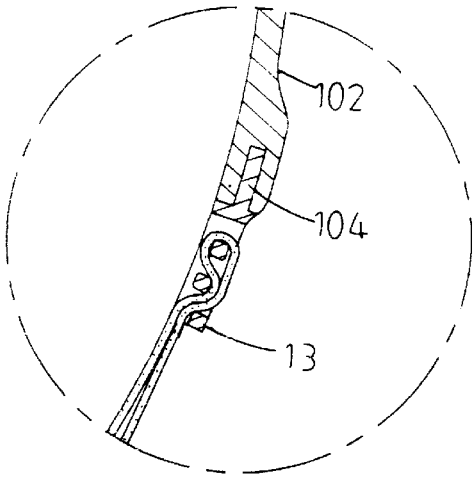
FIG. 3A is an enlarged view of a circle in FIG. 3.

Referring to FIGS. 2, 3, and 3A, each extension strip 102 includes a recess 104 defined in the distal end thereof into which the buckle 13 is disposed. The buckle 13 is made of rigid material and may include a plurality of holes 131 (FIG. 2) defined in a first end thereof. The extension strap is molded around the first end of the bracket 13 such that the plurality of holes 131 in the first end of the buckle 13 are filled with the plastic material which forms the extension strip 102. Therefore, the hard plastic buckle 13 is securely retained to the the extension strip 102 by means of injection molding the extension strip 102 to the buckle 13.

In use, referring to FIGS. 3 and 3A, since the buckles 13 are mounted to distal ends of the extension strips 102, the protective walls 101 may have a close contact with the eye sockets of the user.

Figure 4:
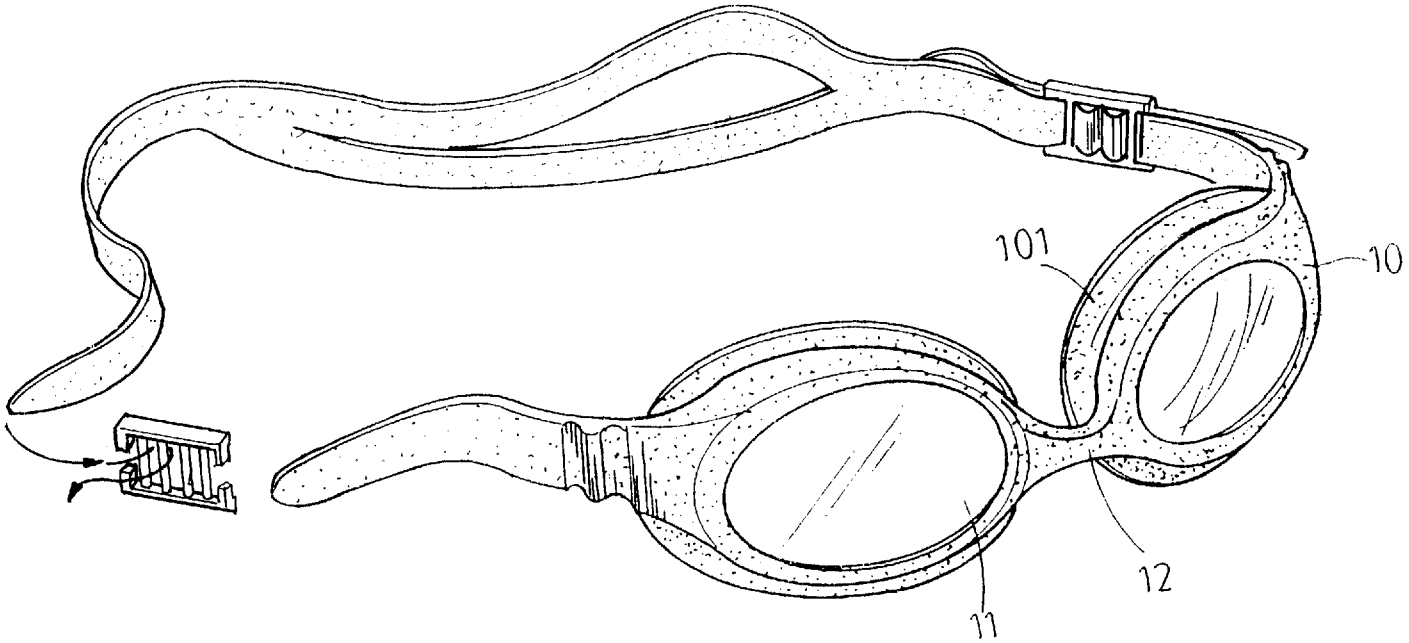
FIG. 4 is a perspective view illustrating a modified embodiment of the present invention.
Figure 5:
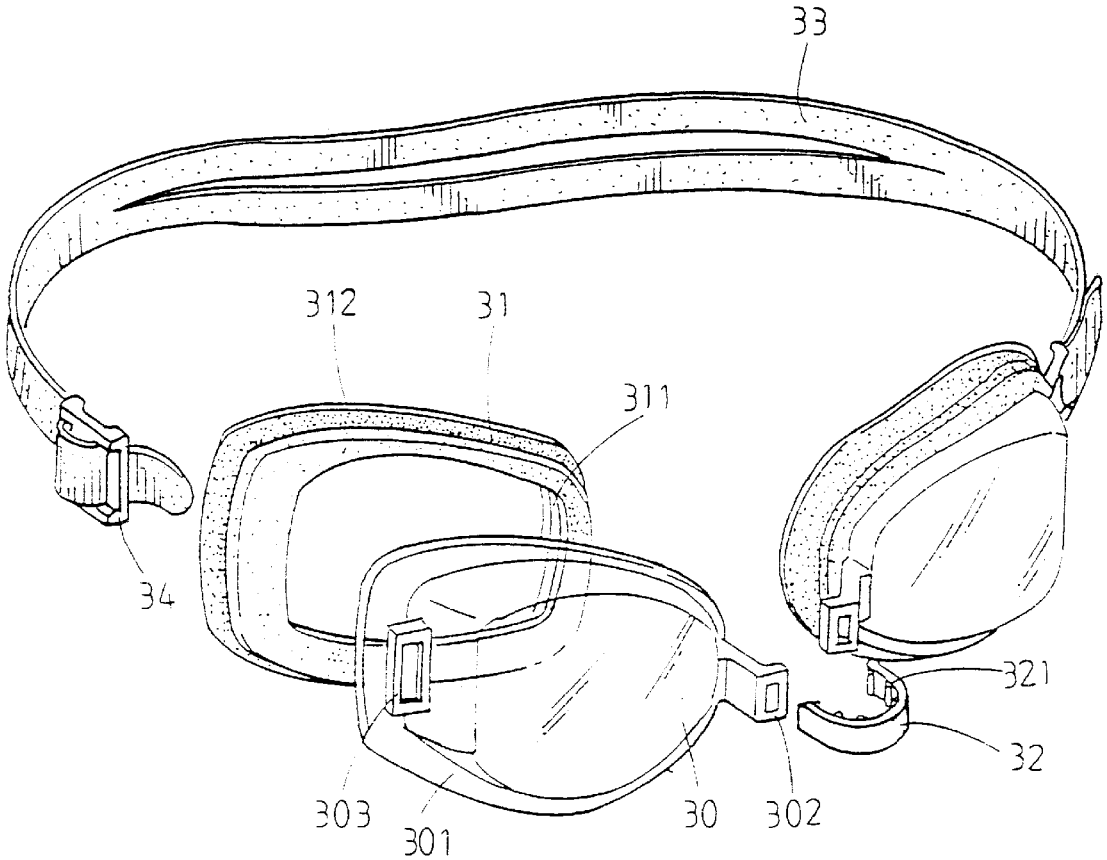
F I G. 5 PRIOR ART
FIG. 5 is a perspective view, partly exploded, of a pair of goggles according to prior art.
Figure 6:
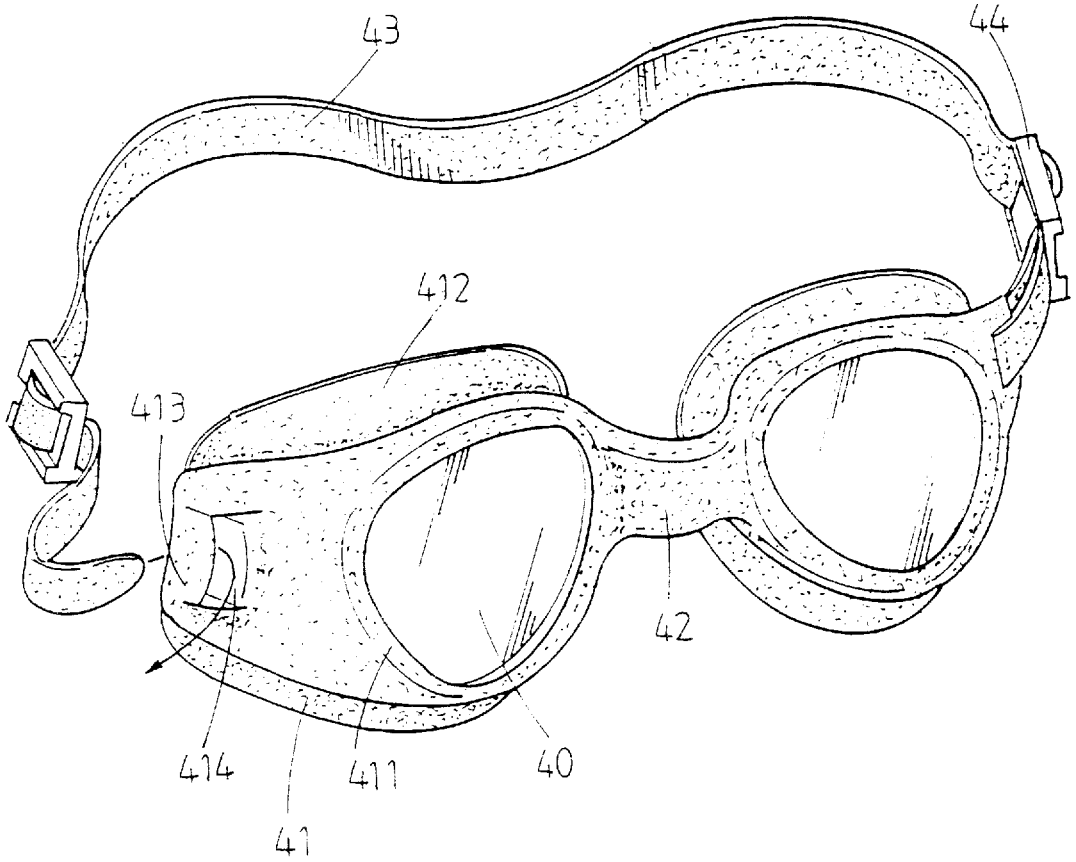
FIG. 6 PRIOR ART
FIG. 6 is a perspective view of another pair of goggles according to prior art.
Figure 7:
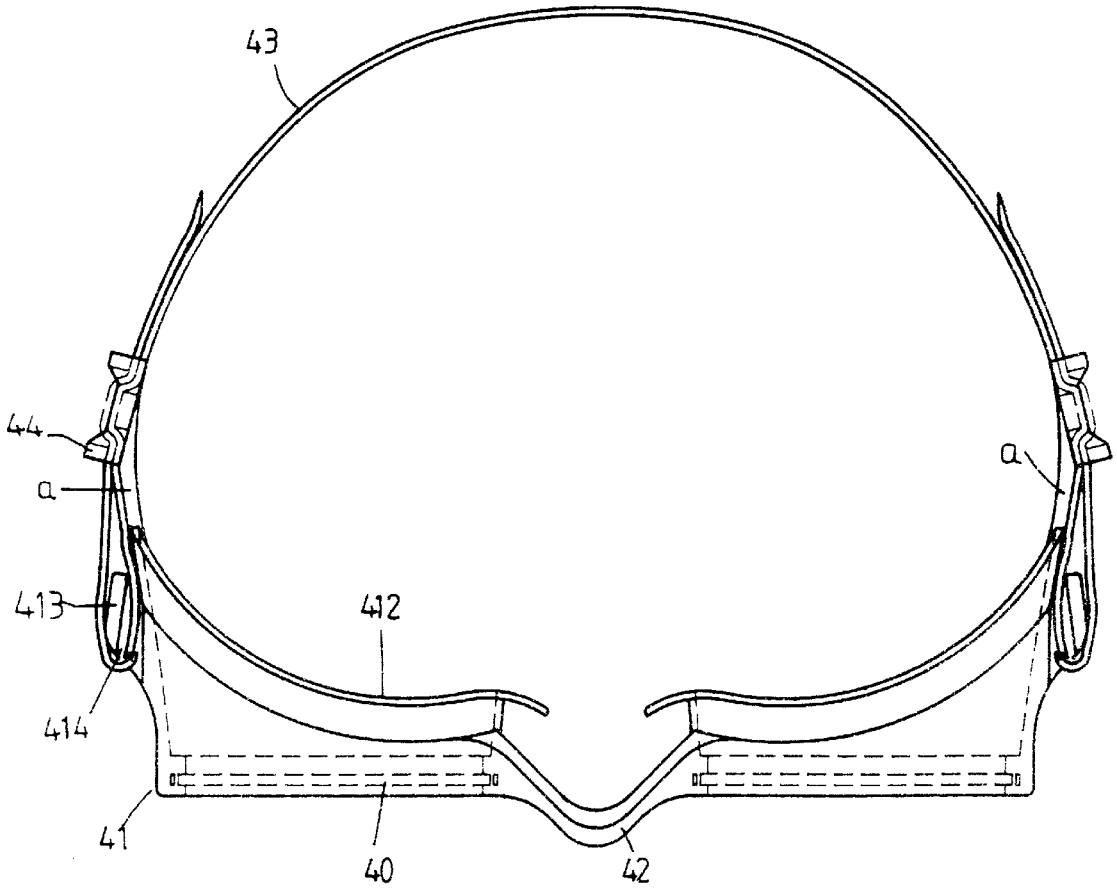
F I G. 7 PRIOR ART
FIG. 7 is a top view of the goggles in FIG. 6.

FIG. 4 illustrates a modified embodiment of the invention, in which the buckles 13 are separate from the extension strips 102 without adversely affecting the water-proof function of the protective walls 101.

Although the invention has been explained in relation to its preferred embodiment, it is to be understood that many other possible modifications and variations can be made without departing from the spirit and scope of the invention as hereinafter claimed.

What is claimed is:

1. A pair of goggles, comprising:

a pair of buckles formed of a rigid material, each of said pair of buckles having a plurality of holes formed through an end portion thereof;

a pair of ring frames, each of said pair of ring frames having an annular protective wall formed on one side thereof for contact with an eye socket portion of a user, each of said pair of ring frames having a lateral side extended to form an integral extension strip, each said extension strip being formed of a deformable plastic material and having an indented section with a thickness less than a thickness of a remaining portion of said extension strip to thereby be conformable to a contour of the user's head, each said extension strip having a distal end disposed a substantial distance from said lateral side of a respective one of said pair of ring frames, said distal end being molded around said end portion of a respective one of said pair of buckles to thereby locate each said buckle a substantial distance from a respective one of said pair of ring frames to provide a close contact between said annular protective walls and the eye socket portions of the user, each of said buckles being retained to said distal end of a respective one of said extension strips by said plastic material passing through said plurality of holes during said molding of said extension strips;

a pair of rigid lenses secured respectively to said pair of ring frames;

a bridge extending between said pair of ring frames; and, a strap having a pair of opposing ends respectively releasably coupled to said pair of buckles.

* * * * *